US007665812B2

(12) United States Patent
Walla

(10) Patent No.: US 7,665,812 B2
(45) Date of Patent: Feb. 23, 2010

(54) LOCKING SYSTEM FOR DRAWERS

(75) Inventor: Gregg W. Walla, Lake Bluff, IL (US)

(73) Assignee: CompX International Inc., Greenville, SC (US)

( * ) Notice: Subject to any disclaimer, the term of this patent is extended or adjusted under 35 U.S.C. 154(b) by 389 days.

(21) Appl. No.: 11/493,868

(22) Filed: Jul. 26, 2006

(65) Prior Publication Data

US 2007/0024164 A1 Feb. 1, 2007

Related U.S. Application Data

(60) Provisional application No. 60/702,550, filed on Jul. 26, 2005.

(51) Int. Cl.
*E05B 65/46* (2006.01)

(52) U.S. Cl. ..... 312/219; 312/221

(58) Field of Classification Search ..... 312/216–221
See application file for complete search history.

(56) References Cited

U.S. PATENT DOCUMENTS

| | | | | | |
|---|---|---|---|---|---|
| 3,497,280 | A | * | 2/1970 | Karel et al. | 312/219 |
| 3,957,324 | A | * | 5/1976 | Klenik et al. | 312/218 |
| 4,168,103 | A | * | 9/1979 | Hagen | 312/219 |
| 4,609,233 | A | | 9/1986 | Walla | |
| 4,761,978 | A | | 8/1988 | Walla | |
| 4,838,624 | A | | 6/1989 | Walla | |
| 4,914,932 | A | | 4/1990 | Walla | |
| 4,925,257 | A | | 5/1990 | Frederiksen et al. | |
| 5,358,322 | A | * | 10/1994 | McLaughlin | 312/219 |
| 5,567,027 | A | * | 10/1996 | McClung et al. | 312/219 |
| 5,678,437 | A | | 10/1997 | Walla | |
| 5,997,114 | A | * | 12/1999 | Bischoff | 312/215 |
| 6,109,708 | A | | 8/2000 | Walla et al. | |
| 6,170,927 | B1 | * | 1/2001 | Dykstra et al. | 312/220 |
| 6,890,043 | B2 | * | 5/2005 | Haworth et al. | 312/218 |
| 6,926,377 | B2 | | 8/2005 | Lammens et al. | |
| 6,969,129 | B2 | | 11/2005 | Ludwig et al. | |
| 2004/0100166 | A1 | * | 5/2004 | Hoffman | 312/219 |

FOREIGN PATENT DOCUMENTS

DE 3304574 * 8/1984

* cited by examiner

*Primary Examiner*—Hanh V Tran
(74) *Attorney, Agent, or Firm*—Dority & Manning, P.A.

(57) ABSTRACT

A locking system for drawers may include a lock with a lock driver that is configured for engaging a drive actuator. The drive actuator may have a lock bar slider in communication with a lock bar. A slave actuator may also be provided in communication with the drive actuator through a shaft. The drive actuator and slave actuator may be respectively positioned so as to lock opposite ends of a drawer. The locking system may also provide the lock with a lock driver that is prevented from being moved into a locked position when the drawer is opened. One of several different resulting arrangements prevents unintentional or inadvertent locking until the drawer is placed into engagement with a drive actuator.

9 Claims, 14 Drawing Sheets

Fig. 3a
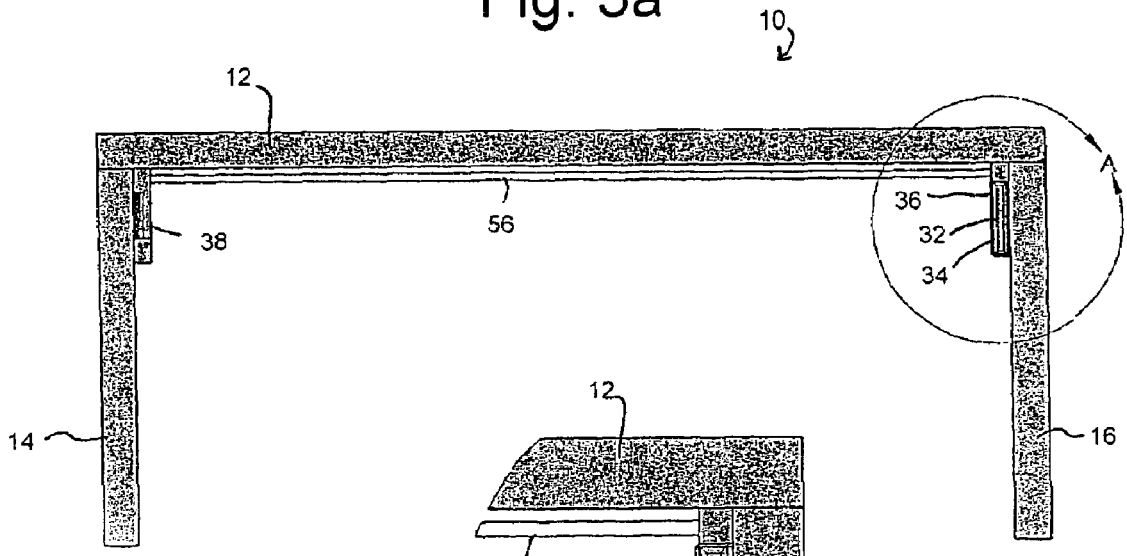
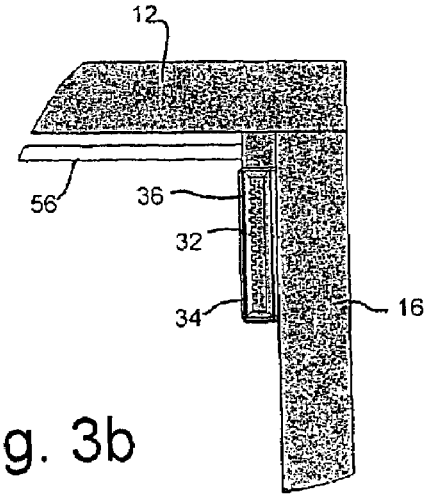
Fig. 3b

LOCKING SYSTEM FOR DRAWERS

PRIORITY CLAIM

This application claims the benefit of previously filed U.S. Provisional Patent Application entitled "LOCKING SYSTEM FOR DRAWERS," assigned U.S. Ser. No. 60/702,550, filed Jul. 26, 2005, and which is incorporated herein by reference for all purposes.

BACKGROUND OF THE INVENTION

Drawers found in chests, stands, cabinets, furniture and the like typically employ locking mechanisms for security. For example, lateral file cabinets generally have a locking mechanism for use in locking one or more drawers in order to safely store files therein. Some locking mechanisms employ a lock that is attached to a drawer of the file cabinet and that is actuated by a user through a key. The lock engages an actuator located in the file cabinet when the drawer of the file cabinet is closed. The actuator is in turn connected to a lock bar that slides vertically with respect to the file cabinet.

Rotational motion created by turning the key in the lock is thus transferred into vertical motion of the lock bar. Typically, the drawers of the file cabinet include a drawer-locking clip that limits, through contact with a pin on the lock bar, movement of the drawer. In this manner, the drawers of the file cabinet may be locked.

Locking systems incorporated into file cabinets may tend to have certain disadvantages. For example, the lock and associated actuator may be located on one side of the drawer. Although the side of the drawer with the lock may be prevented from being opened, the opposite side of the drawer may be able to be opened a large distance, thus compromising the security of the file cabinet. Alternatively, the lock may be located at the center of the drawer. Such arrangement may be problematic in that a shaft used to communicate rotation of the lock to the actuator and/or the lock bar may interfere with files placed into the file cabinet.

Locking systems on file cabinets are also susceptible to improper locking by the user. For example, users sometimes will open a drawer of the file cabinet and turn the lock into a locked position even though the drawer is open. Upon closing the drawer, the lock is then not capable of being placed into the locked position in order to lock the file cabinet.

Various disclosures concern designs relating to locking systems, particularly relating to furniture which includes such as drawers, including the following U.S. patents: U.S. Pat. No. 6,926,377 entitled Drawer slide latch and release mechanism; U.S. Pat. No. 6,969,129 entitled Anti-tip interlocking linkage mechanism for vertical cabinets; U.S. Pat. No. 6,109,708 entitled Locking mechanism for drawer system; U.S. Pat. No. 5,678,437 entitled Lock for furniture closure; U.S. Pat. No. 4,925,257 entitled Safety lock system for cabinet with multiple drawers; U.S. Pat. No. 4,914,932 entitled Lock with key operated removable plug; U.S. Pat. No. 4,838,624 entitled Furniture anti-tip and lock mechanism; U.S. Pat. No. 4,761,978 entitled Lock with key operated removable plug; U.S. Pat. No. 4,609,233 entitled Furniture locking system.

The disclosures of the foregoing United States patents are for all purposes hereby fully incorporated into this application by reference thereto.

The present subject matter provides for a locking system for drawers that improves upon and overcomes problems associated with current locking systems.

SUMMARY OF THE INVENTION

Various features and advantages of the present subject matter will be set forth in part in the following description, or may be apparent from the description, or may be learned from practice of the present subject matter. In view of the recognized features encountered in the prior art and addressed by the present subject matter, an improved apparatus and corresponding methodology for locking systems for drawers has been provided.

In a broader present object, drawer locking system methodology and corresponding apparatus are provided for improved locking functionality, particularly across the width of a drawer. In some present embodiments, it is also a present object to provide such improved functionality generally regardless of any drawer misalignment over time.

It is another present object of the present subject matter to provide a locking system for use such as with a set of drawers. In one exemplary present embodiment, such a locking system may advantageously be used with a file cabinet.

The present locking system in certain embodiments thereof may employ a lock that engages a drive actuator to move a lock bar into a desired position for locking one or more drawers of such an exemplary file cabinet. A follower or slave actuator may also be provided and may through use of a shaft be placed into communication with the drive actuator. The follower or slave actuator may be used to move a lock bar into a desired position for locking one or more drawers of the file cabinet. In such embodiments, it is also a present object that the main or drive actuator (primary actuator) and slave or follower actuator (secondary actuator) may be respectively positioned in order to lock opposite ends of a drawer, to provide increased security of items stored in the file cabinet.

Additionally or alternatively, per one exemplary embodiment of the present locking system, such system may include a lock with a lock driver that is urged into a notch in order to prevent the lock driver from being moved into a locked position when a drawer of the file cabinet is opened. In such context, a resilient member (for example, such as a spring) may be used in order to urge the lock driver into the notch to prevent a user from inadvertently or unintentionally locking the lock when the drawer is open. In such embodiment, upon closing the drawer, such an exemplary lock driver engages a chamfer carried by a driver of the drive actuator that causes the lock driver to be pushed against the spring and out of the notch. In such manner, the lock driver is allowed to be moved into a locked position in order to effect locking of one or more drawers of the file cabinet.

The present subject matter also provides for an exemplary embodiment of the locking system as described above in which the driver of the drive actuator includes a spline. The lock driver of the lock may engage and mesh with the spline. Movement of the lock driver causes a corresponding movement of the spline and driver to drive the drive actuator.

In a present alternative to such lock driver/spline and notch embodiment, various such features may be replaced through use instead of a plunger pin arrangement that brakes the action of the lock until it is pushed inward when specifically mated with an actuator assembly.

A further exemplary embodiment of the locking system exists as substantially described above in which the shaft that connects the drive (primary or main) actuator and the slave (secondary or follower) actuator is positioned in close proximity to a top panel of the file cabinet. Such positioning eliminates or minimizes interference between the shaft and items, such as files, that may be stored in the drawers of the file cabinet. Similarly, a relatively lower profile or projection of the lock features of the present subject matter relative to a drawer and/or filing cabinet with which the subject-matter is used helps minimize interference of such physical elements with their environment, such as persons moving around the filing cabinet or files or other materials being moved in the vicinity of the filing cabinet.

The present subject matter also provides for an exemplary embodiment of the locking system as described above in which the drive actuator is configured to be non-proportional so that movement of the driver over a certain distance causes a lock bar slider to move a greater distance. A further exemplary embodiment exists in a locking system as immediately discussed in which movement of up to 60% of the travel distance of the driver causes movement of up to 90% of the travel distance of the lock bar slider.

Another exemplary embodiment of the present subject matter relates to a locking system for a file cabinet having at least one drawer which is movable between an open and closed position thereof relative to the file cabinet, and which file cabinet has respective left and right side panels and respective left and right lock bars that slide generally vertically within the file cabinet for engaging the drawer in the file cabinet and alternately locking and unlocking such drawer depending on their vertical positioning. Such exemplary locking system preferably includes a lock, a drive actuator, a connection member, and a follower actuator.

In the foregoing exemplary present arrangement, such exemplary lock may have a keyhole for receipt of a key therein for placing such lock in one of either a predetermined locked position or a predetermined unlocked position thereof. Such exemplary drive actuator may be preferably engaged with such lock and associated with one of the respective left and right lock bars, such that movement of such lock between its locked and unlocked positions is translated by the drive actuator into vertical slide motion of the associated one lock bar for corresponding locking and unlocking of the drawer. Such exemplary connection member may be preferably operatively associated with such drive actuator for corresponding movement thereof as the associated one lock bar is moved by such drive member. Such exemplary follower actuator may preferably be engaged with such drive actuator via the referenced connection member and associated with the other of the respective left and right lock bars, such that movement of such lock between its locked and unlocked positions which is translated by such drive member to the associated one lock bar is also translated by such follower actuator into vertical slide motion of the associated other lock bar for corresponding locking and unlocking of the drawer, such that locking and unlocking functionality of such lock is positively translated across the width of the drawer between the respective left and right side panels of the file cabinet.

In some embodiments of the foregoing exemplary locking system, the drive actuator may be provided so that the vertical slide movement effected by such drive actuator is not one-to-one proportional to the actuating movement received by such drive actuator, and in some embodiments, such file cabinet may include more than one drawer.

Yet another present exemplary embodiment may relate to a locking system for a file cabinet having a plurality of drawers which are movable between respective open and closed positions thereof relative to the file cabinet, and which file cabinet has respective left and right side panels. Such exemplary locking system may include a lock, respective left and right lock bars, a connecting shaft member, a primary actuator, and a secondary actuator.

In the foregoing exemplary embodiment, such lock may have a keyhole for receipt of a key therein for placing such lock in one of either a predetermined locked position or a predetermined unlocked position thereof in response to corresponding rotational movement of a key in such keyhole. Such lock bars may comprise elongated respective left and right lock bars that slide generally vertically within the file cabinet for respectively engaging the plurality of drawers in the file cabinet and alternately locking and unlocking such drawers depending on their vertical positioning. Such exemplary connecting shaft member may preferably be rotatably supported by the file cabinet, and have respective ends thereof situated respectively adjacent to the respective left and right side panels of the file cabinet. Such exemplary primary actuator may preferably be operatively engaged with such lock, with one of said respective left and right lock bars, and with one respective end of such connecting shaft member, such that movement of such lock between locked and unlocked positions thereof is translated by such primary actuator into vertical slide motion of such associated one lock bar for corresponding locking and unlocking of the drawers, and is translated into rotational movement of such connecting shaft member. Still further, such exemplary secondary actuator may preferably be engaged with the other respective end of such connecting shaft member and associated with the other of such respective left and right lock bars, such that movement of such lock between locked and unlocked positions thereof which is translated by such primary member to such one respective end of the connecting shaft member is also translated by such secondary actuator into vertical slide motion of the associated other lock bar for corresponding locking and unlocking of the drawers. In such manner, locking and unlocking functionality of such lock advantageously is positively translated across the width of the drawers to both of such left and right lock bars.

Still further exemplary embodiments of the present subject matter may relate to an improved file cabinet locking system for a file cabinet having a plurality of drawers which are movable between respective open and closed positions thereof relative to the file cabinet, and which file cabinet has respective left and right side panels. Such locking system may preferably include a lock, respective left and right lock bar means, rotatable shaft means, primary actuator means, and secondary actuator means.

In the foregoing exemplary embodiment, such lock may preferably have a keyhole for receipt of a key therein for placing such lock in one of either a predetermined locked position or a predetermined unlocked position thereof in response to corresponding rotational movement of a key in such keyhole. Such respective left and right lock bar means may preferably be supported by the file cabinet so as to engage the plurality of drawers thereof, and operative for alternately locking and unlocking such drawers. Such exemplary rotatable shaft means may preferably be provided for translating rotatable movement across the width of the drawers between the respective left and right side panels of the file cabinet. The exemplary primary actuator means may preferably be operatively engaged with the lock, with one of the respective left and right lock bar means, and with the rotatable shaft means, and operative for actuating such associated one lock bar means in response to movement of such lock between locked and unlocked positions thereof, for corresponding locking and unlocking of the drawers, and for correspondingly rotating the rotatable shaft means. Still further with reference to such exemplary present embodiment, the exemplary secondary actuator means may preferably be operatively engaged with the rotatable shaft means and with the other of the respective left and right lock bar means, and operative for actuating the associated other lock bar means in response to rotation of the rotatable shaft means by such primary actuator means, such that locking and unlocking functionality of the lock is positively translated across the width of the drawer to both of the left and right lock bar means.

In some embodiments of the foregoing exemplary improved file cabinet locking system in accordance with the present subject matter, such primary actuator means may further include safety interlock means operatively associated with the lock, and operative for preventing such lock from assumed the locked position thereof whenever a drawer of the file cabinet is in an open position thereof.

Still further in some embodiments of the foregoing exemplary improved file cabinet locking system, actuating of such associated one lock bar means by the primary actuator means may not be one-to-one proportional to movement of such lock between locked and unlocked positions thereof. Also, in some particular embodiments of the foregoing, such primary actuator means may further include adjustment screw means for adjusting operation of the primary actuator means.

These and other features, aspects and advantages of the present subject matter will become better understood with reference to the following description and appended claims. The accompanying drawings, which are incorporated in and constitute part of this specification, illustrate embodiments of the present subject matter, and together with the description serve to explain the principles of the present subject matter.

Additional objects and advantages of the present subject matter are set forth in, or will be apparent to, those of ordinary skill in the art from the detailed description herein. Also, it should be further appreciated that modifications and variations to the specifically illustrated, referred and discussed features, elements, and steps hereof may be practiced in various embodiments and uses of the present subject matter without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the present subject matter may include various combinations or configurations of presently disclosed features, steps, or elements, or their equivalents including combinations of features, parts, or steps or configurations thereof not expressly shown in the figures or stated in the detailed description of such figures. Those of ordinary skill in the art will better appreciate the features and aspects of such embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth more particularly in the remainder of the specification, which makes reference to the appended Figures in which:

FIG. 3*a* is a front view of a portion of the exemplary file cabinet of FIG. 1;

FIG. 3*b* is a more detailed view of the exemplary subject matter within circle A of FIG. 3*a;*

Figure 1:
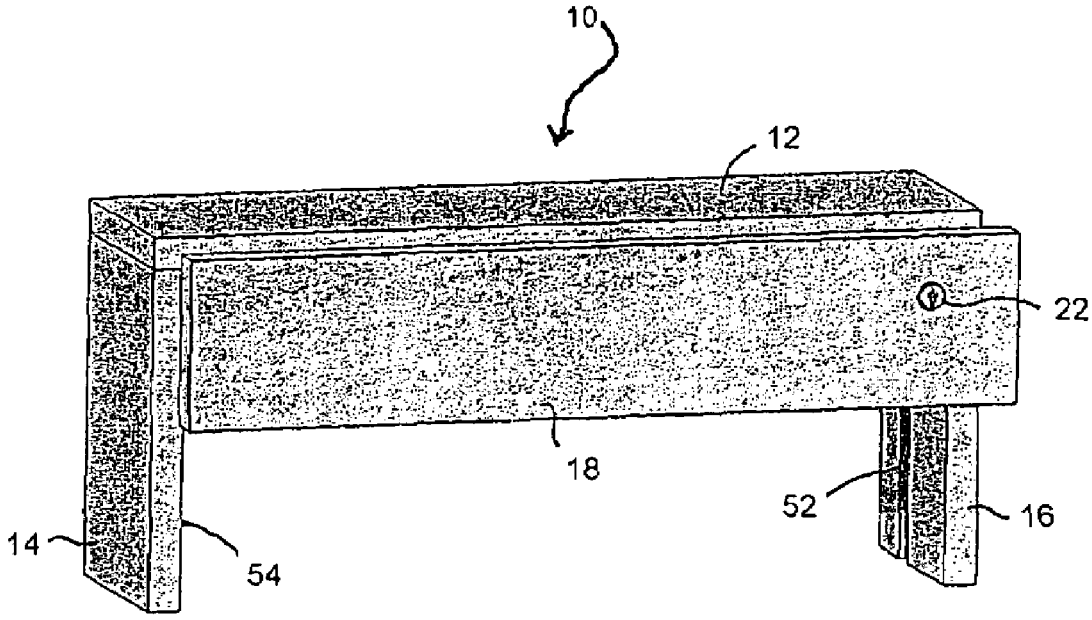
FIG. 1 is a perspective view of a portion of an exemplary file cabinet that includes an exemplary locking system in accordance with a first present exemplary embodiment.

Repeat use of reference characters in the present specification and drawings is intended to represent the same or analogous features or elements of the present subject matter.

DETAILED DESCRIPTION OF THE PREFERRED EMBODIMENTS

As discussed in the Summary of the Invention section, the present subject matter is particularly concerned with corresponding methodology and apparatus for improved locking functionality, particularly across the width of a drawer, for drawer locking system methodology and corresponding apparatus. It is also a present object to provide such improved functionality generally regardless of any drawer misalignment over time. It is another present object of the present subject matter to provide a locking system for use such as with a set of drawers. In one exemplary present embodiment, such a locking system may advantageously be used with a file cabinet.

Selected combinations of aspects of the disclosed technology correspond to a plurality of different embodiments of the present subject matter. It should be noted that each of the exemplary embodiments presented and discussed herein should not insinuate limitations of the present subject matter. Features or steps illustrated or described as part of one embodiment may be used in combination with aspects of another embodiment to yield yet further embodiments. Additionally, certain features may be interchanged with similar devices or features not expressly mentioned which perform the same or similar function.

Reference will now be made in detail to embodiments of the present subject matter, one or more examples of which are illustrated in the drawings. Each example is provided by way of explanation of the present subject matter, and not meant as a limitation of the present subject matter. For example, features illustrated or described as part of one embodiment can be used with another embodiment to yield still a third embodiment. It is intended that the present subject matter include these and other modifications and variations.

In general, the illustrations of FIGS. 1-7, inclusive, relate to a first present exemplary embodiment of the present subject matter, while the illustrations of FIGS. 8-14, inclusive, relate to a second present exemplary embodiment of the present subject matter. Repeat use of reference characters in the respective embodiments of the respective groups of drawings is intended to represent the same or analogous features or elements of the present subject matter, with only different reference characters respectively thereof indicating and/or representing respectively different features.

The present subject matter improves upon previous locking systems that may be used in locking drawers present in, for example, lateral file cabinets. For example, respective FIGS. 1 and 8 (and others) represent that the present systems provide for various arrangements (including, but not limited to, respective first and second exemplary embodiments thereof) that prevent a user from inappropriately moving a lock 20 into a locked position while a drawer 18 of a representative file cabinet generally 10 is opened. In such manner, exemplary lock 20 will be in the open position when drawer 18 is opened and will be able to be moved into the locked position when representative drawer 18 is closed. Additionally, the present systems provide for a locking arrangement that allows for such drawer 18 to be locked at both the left hand side panel generally 14 and the right hand side panel generally 16. By locking the drawer 18 at both of the side panels 14 and 16, the security of the file cabinet 10 is increased in accordance with the present features because the amount the drawer 18 can be opened across the exposed length (i.e., width) of the drawer 18 is minimized.

Figure 8:
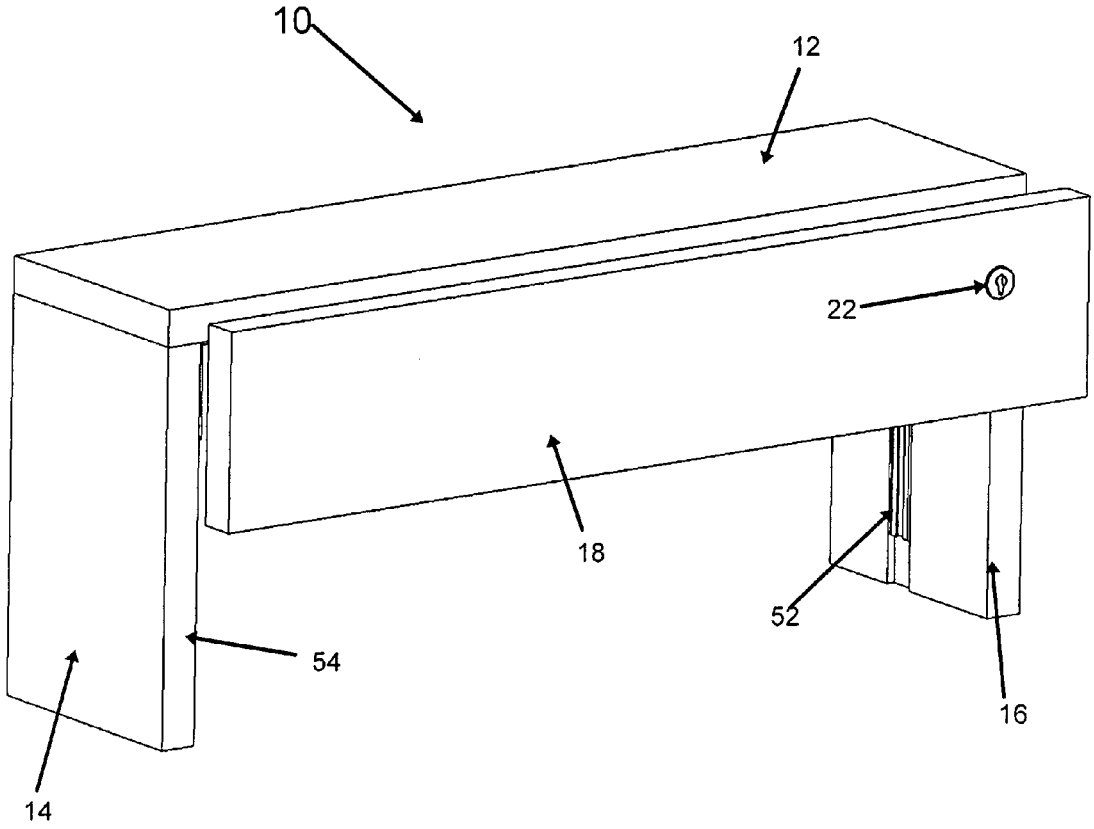
FIG. 8 is a perspective view of a portion of an exemplary file cabinet that includes an exemplary locking system in accordance with a second present exemplary embodiment.

FIGS. 1 and 8 respectively represent exemplary first and second present embodiments of a file cabinet 10 combined and/or used with present locking system subject matter. The file cabinet 10 includes a top panel 12 with a pair of side panels 14 and 16 extending therefrom. A drawer 18 of the file cabinet 10 is positioned between the side panels 14 and 16. The side panels 14 and 16 may house lock bars (respective left and right lock bar means) 52 and 54, generally in a manner well known to those of ordinary skill in the art without further specific discussion.

Lock bars 52 and 54 are configured to slide in a vertical direction, also as well understood. A plurality of pins (not shown) are typically positioned along the length of such representative lock bars 52 and 54, and are moved into and out of alignment with drawer locking clips (not shown) that are positioned on the various drawers 18 of the representative file cabinet 10. Their purpose and function is to alternately either allow or prevent drawer 18 from opening.

The present systems of the present subject matter of FIGS. 1-14 may generally be used with (or adapted for use with) any type of such lock bars 52 and 54 that are used to alternately allow or prevent the opening and closing, respectively, of the drawers 18, as is commonly known in the art.

The present exemplary locking arrangements allow for a lock 20 to be positioned at either the left hand or right hand side of the drawer 18. In such regard, lock 20 may be positioned proximate to either the left hand side panel 14 or the right hand side panel 16.

Lock 20 employs a keyhole 22 by which it may receive a key for being turned to either of a locked position or an unlocked positioned, as is commonly understood in the art. Lock 20 may be configured so that such key can be turned 180° in order to go from a locked position to an unlocked position. Alternatively, lock 20 may be configured so that the key may be turned less than 180° or greater than 180° for effectuating movement corresponding to locked and unlocked positions, respectively.

Figure 2:
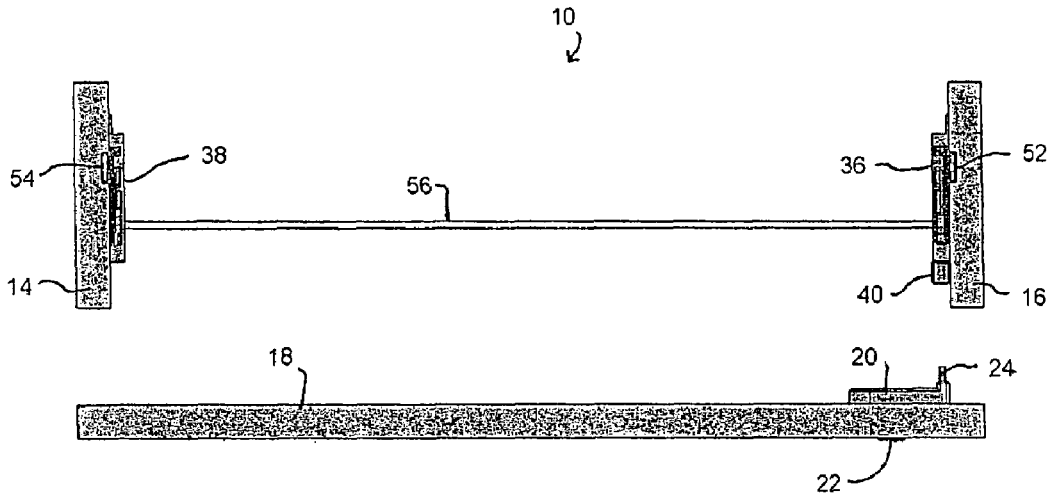
FIG. 2 is a top cross-sectional view of a portion of the exemplary file cabinet of FIG. 1.
Figure 9A:
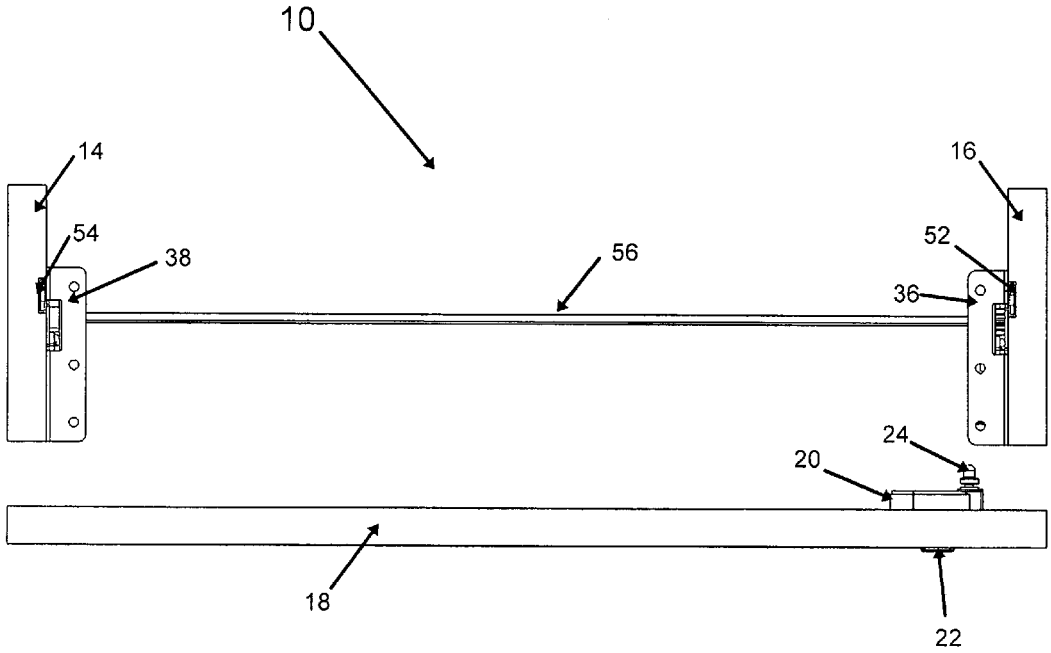
FIG. 9*a* is a top cross-sectional view of a portion of the exemplary file cabinet of FIG. 8.
Figure 9B:
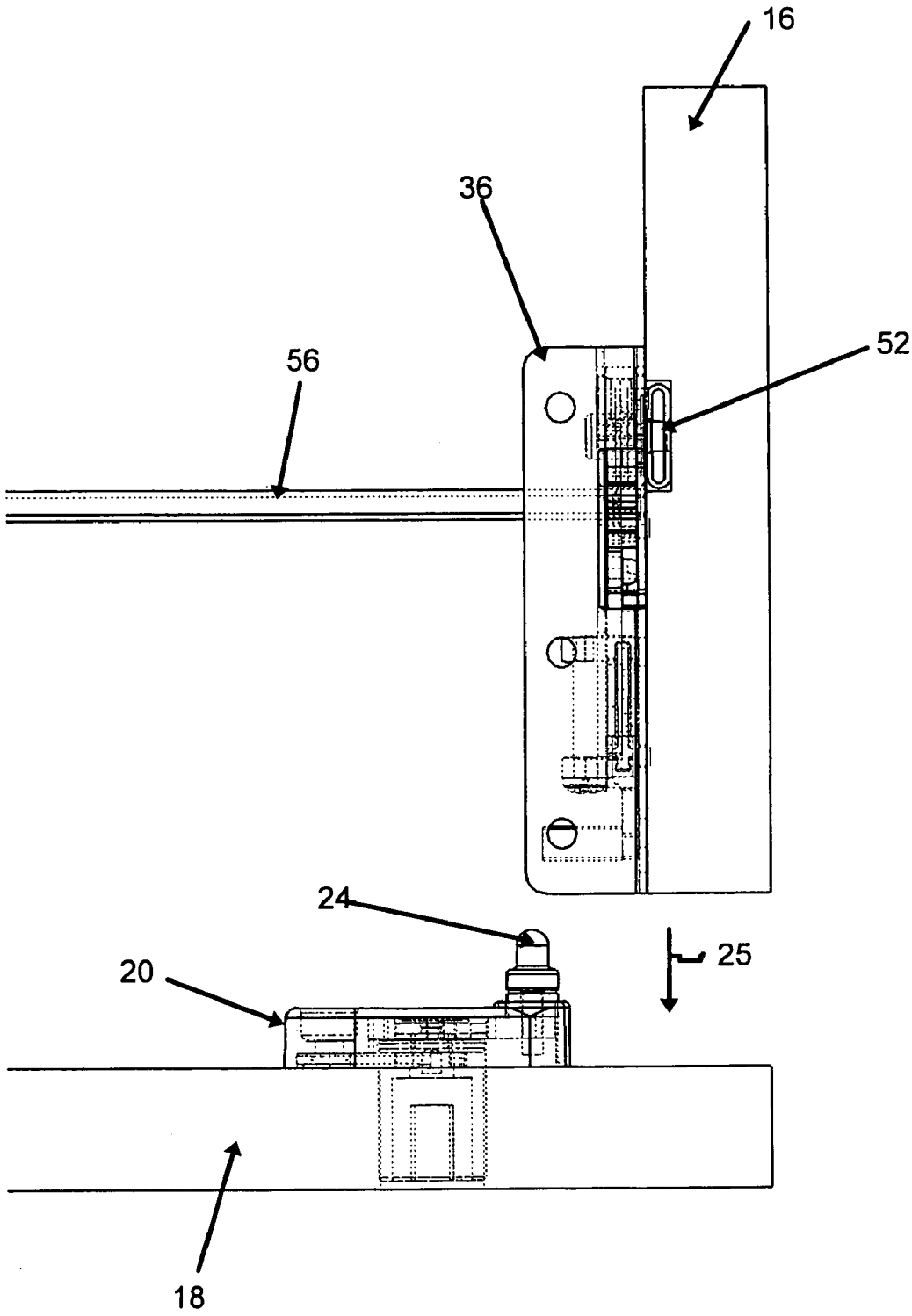
FIG. 9*b* is a top detail view of the upper right hand corner of the exemplary portion of exemplary file cabinet subject matter per subject FIG. 9*a;*

FIGS. 2 and 9*a* show respective top views of a portion of the drawer 18 and the side panels 14 and 16, for respective first and second embodiments of the present subject matter. FIG. 9*b* shows generally a top detail view of the upper right hand corner of the exemplary portion of exemplary file cabinet subject matter per subject FIG. 9*a*, to facilitate comparison and contrasts with the exemplary subject matter of the example of that of FIG. 2.

As shown, lock 20 is mounted on the inside of the drawer 18 and, in these exemplary embodiments, located in the upper right hand corner of drawer 18. In accordance with other exemplary embodiments, lock 20 may be located on the outside surface of the drawer 18 or may be located within the front panel of the drawer 18. It is to be understood that the lock 20 may be positioned at locations on drawer 18 apart from that shown in FIG. 2 or FIGS. 9*a* and 9*b*.

Such present locking systems include a so-called drive actuator 36, mounted for example on the inside of the side panel 16. Such drive actuator 36 may also be thought of as a primary or main actuator or primary actuator means, relative to a slave or secondary or follower actuator or secondary actuator means 38 mounted in a similar manner on the inside of the side panel 14. It is to be understood that the present subject matter equally encompasses embodiments where such paired actuator subject matter and corresponding features are reversed with reference to left and right side panels of the drawer.

Drive (or main or primary) actuator 36 is used in order to actuate exemplary lock bar 52 to move such lock bar 52 into and out of a locked position. In a similar manner, slave (or follower or secondary) actuator 38 is used to move exemplary lock bar 54 into and out of a locked position.

Briefly, lock 20 is configured to be moved into and out of a locked position and communicates with drive actuator 36 so as to likewise move such drive actuator 36 into and out of a locked position. Drive actuator 36 in turn effects movement of lock bar 52 into and out of a locked position.

The follower or secondary/slave actuator 38 is in communication with drive actuator 36 through representative shaft (rotatable shaft means) 56. Such follower actuator 38 is moved into and out of a locked position in order to move exemplary lock bar 54 into and out of a locked position, to correspondingly lock and unlock drawer 18, as will be understood by those of ordinary skill in the art from all the present disclosure.

Figure 10A:
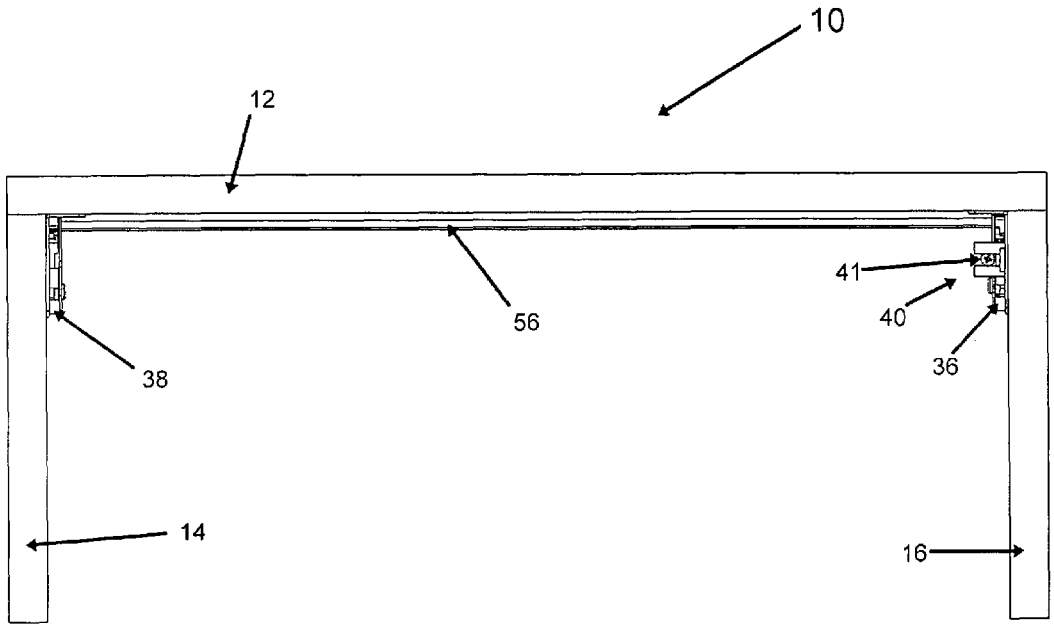
FIG. 10*a* is a front view of a portion of the exemplary file cabinet of FIG. 8.
Figure 10B:
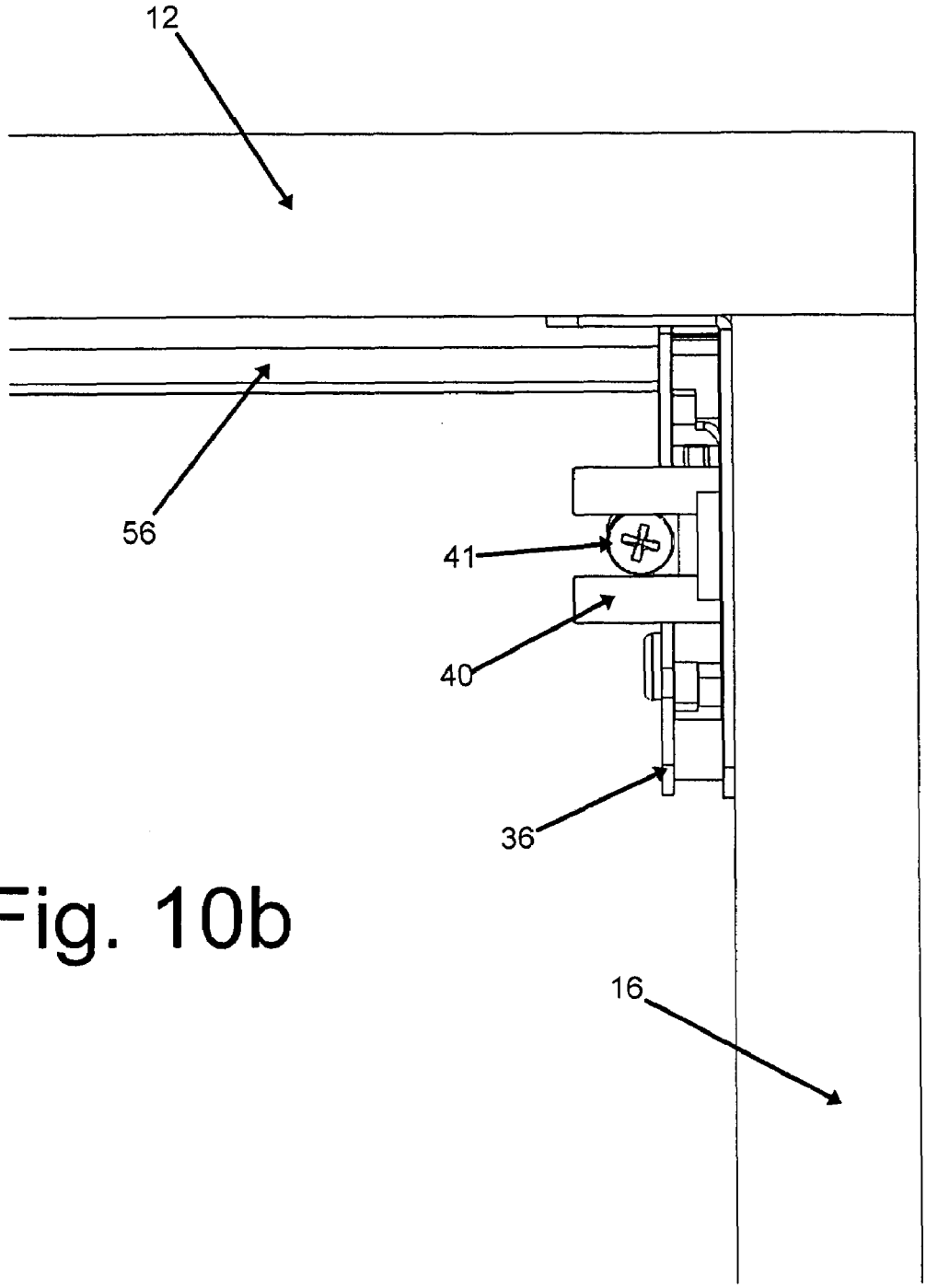
FIG. 10*b* is a more detailed view of the exemplary subject matter within the generally upper right hand corner of FIG. 10*a;*

FIGS. 3*a* and 3*b* are front views of a portion of exemplary file cabinet 10 and associated locking components of a first present embodiment. FIGS. 10*a* and 10*b* are similar views but for a second present embodiment. Reference characters commonly used by both embodiments reflect common features used or usable with both embodiments.

Shaft 56 is shown as being in close proximity to exemplary top panel 12. In accordance with the first exemplary embodiment, shaft 56 may be located up to and including 9/32 inches from the top panel 12. In accordance with other exemplary embodiments, the distance between the top panel 12 and the shaft 56 may be from 1/8 inch to 1/2 inch. By placing shaft 56 in close proximity to the top panel 12, files that are located in the drawer 18 may have ample room for clearance and will not contact or otherwise interfere with shaft 56. As such, larger items may be stored in the drawer 18 and may be less susceptible to interference, thus facilitating easier closing and opening of the drawer 18 and less damage to the items stored therein. Similarly, a relatively lower profile or projection of the lock features of the present subject matter relative to a drawer and/or filing cabinet with which the subject matter is used helps minimize interference of such physical elements with their environment, such as persons moving around the filing cabinet or files or other materials being moved in the vicinity of the filing cabinet.

Figure 4:
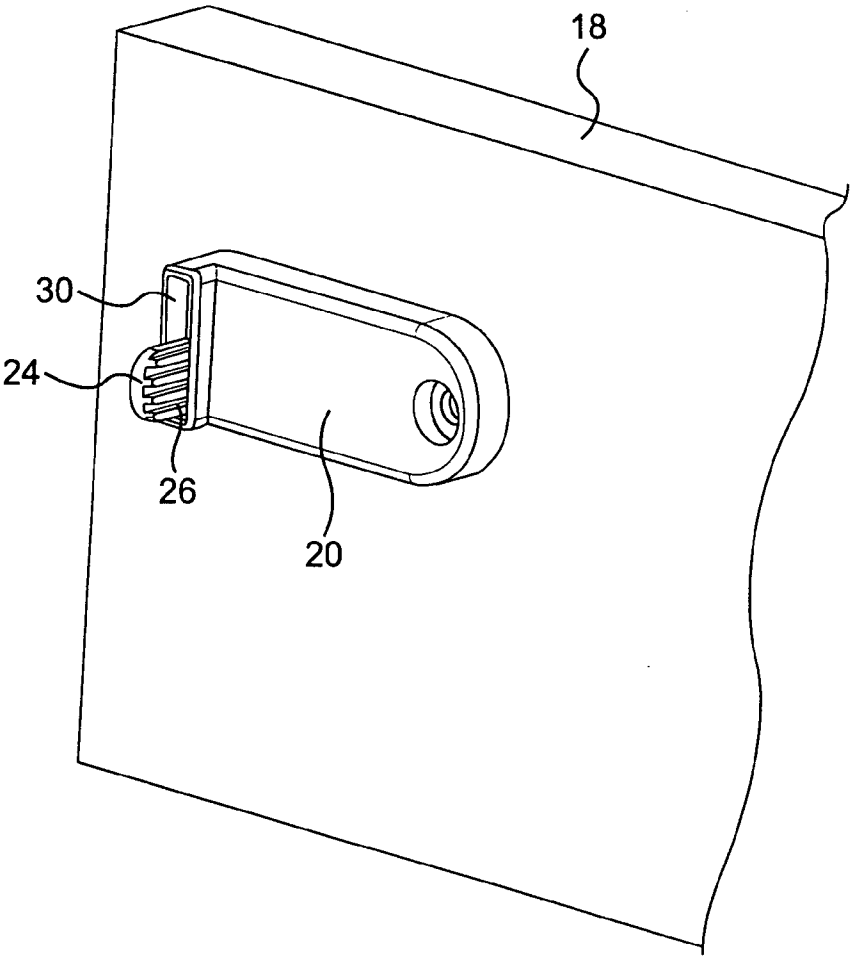
FIG. 4 is a perspective view of an exemplary lock of the exemplary first embodiment locking system mounted onto a drawer in accordance with such first exemplary embodiment.

Drive actuator 36 of the first present exemplary embodiment (FIGS. 3*a* and 3*b*) has a driver 40 with a spline 32 that is oriented in a vertical direction. The spline 32 is configured to receive a lock driver 24 of the lock 20 as shown in FIG. 4. Lock driver 24 has a series of notches on one side thereof that mesh with corresponding notches of the spline 32. The spline 32 may be sized to have a length large enough to compensate for alignment problem that may arise with the file cabinet 10. Commonly, file cabinets 10 may become misaligned in the vertical direction over time, even through normal or typical use of the file cabinet 10, thus causing the lock 20 to become misaligned with the drive actuator 36. Misalignment may be due to a number of reasons, for example, including fatigue brought about by the weight of items placed into the drawer 18 or from forces imparted onto the file cabinet 10 such as the slamming of drawers 18 or twisting and turning caused by moving the file cabinet 10 from one location to another.

In view of the foregoing, spline 32 may preferably be sized to an appropriate length in the vertical direction to ensure that lock 20 is capable of engaging and communicating with the drive actuator 36. In use, the drawer 18 is closed so that the lock driver 24 engages the spline 32. Turning of the lock 20 causes the lock driver 24 to be moved upwards into a locked position.

Communication between keyhole 22 and lock driver 24 of lock 20 may be made in a variety of manners commonly known to one having ordinary skill in the art. For instance, lock 20 may be configured to provide communication between the keyhole 22 and the lock driver 24 through an arrangement in one present exemplary embodiment that includes two gears and an off-centered cam. Movement of lock driver 24 causes a corresponding upward movement of spline 32 due to its engagement with lock driver 34. As discussed in greater detail below, movement of spline 32 causes drive actuator 36 to be moved into and out of a locked position.

FIGS. 10*a* and 10*b* represent an alternative (second present) exemplary embodiment, making use of an adjustment screw 41 as illustrated, in place of the spline-based subject matter involving spline 32 with reference to the first present subject exemplary embodiment. Specifically, adjustment screw (adjustment screw means) 41 provides for any desired relative up and/or down adjustment of driver 40.

Figure 11:
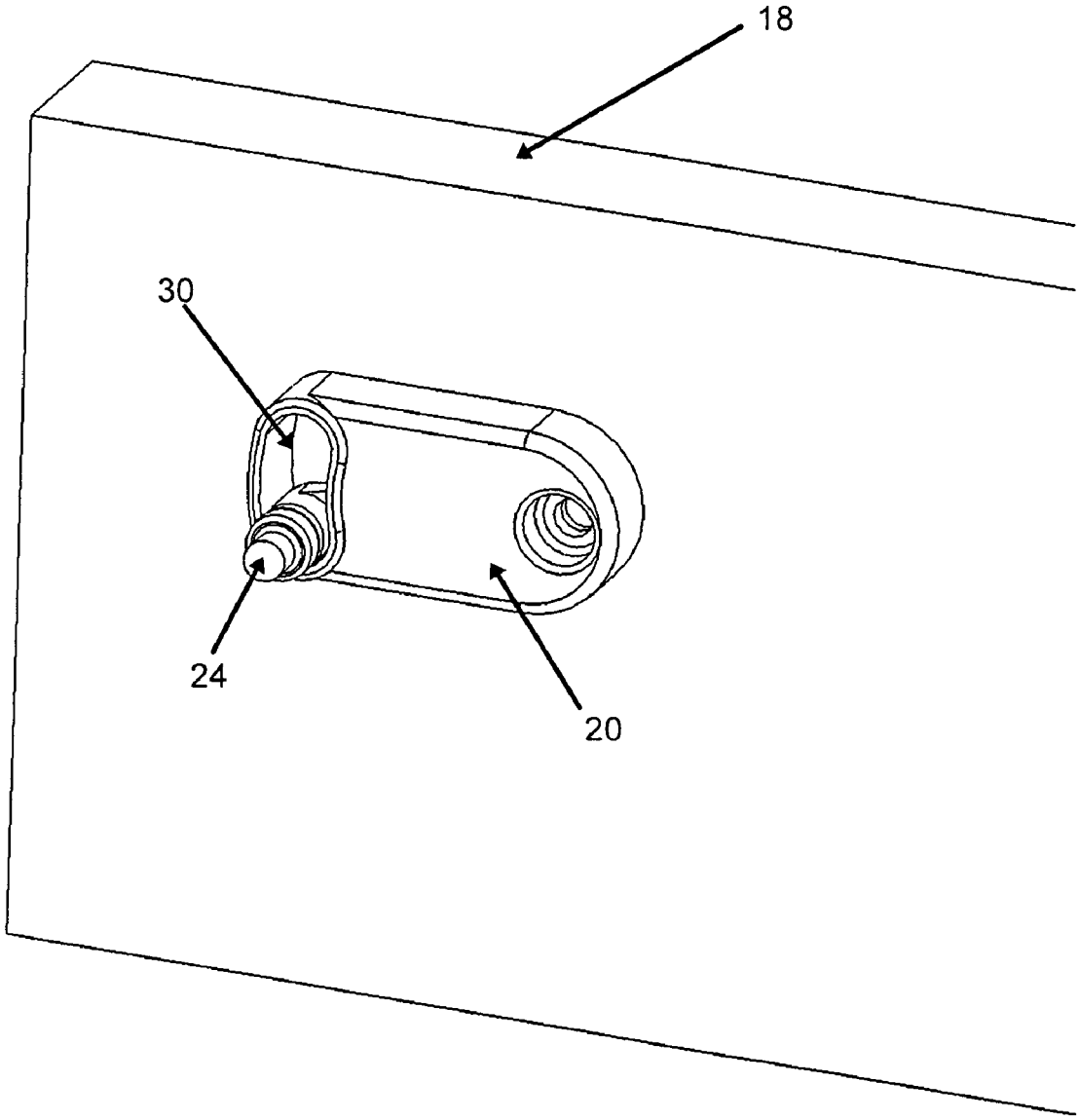
FIG. 11 is a perspective view of an exemplary lock of the exemplary second embodiment locking system mounted onto a drawer in accordance with such second exemplary embodiment.

FIG. 11 represents a view of present second exemplary embodiment subject matter generally corresponding with that of present FIG. 4 with reference to the subject present first exemplary embodiment, such that additional detail discussion of such FIG. 11 is not required for a complete understanding thereof by those of ordinary skill in the art.

Figure 5:
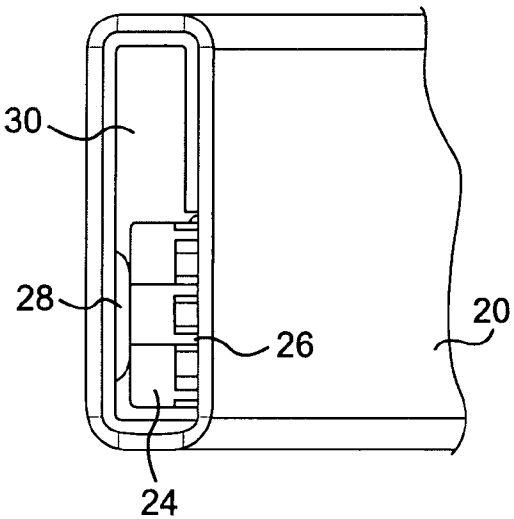
FIG. 5 is a front view of a portion of the exemplary lock of FIG. 4.
Figure 12:
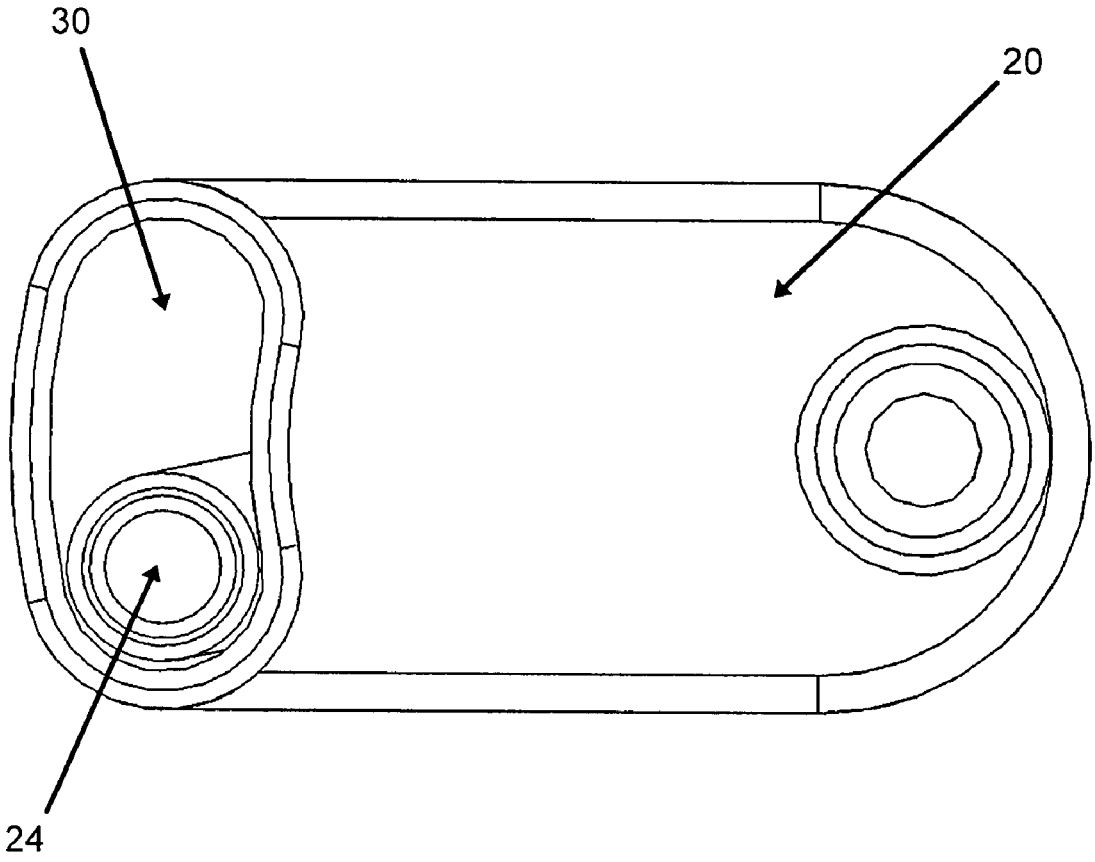
FIG. 12 is an isolated front view of a portion of the exemplary lock of FIG. 11.

A front view of a portion of exemplary present locks 20 are shown by FIGS. 5 and 12, respectively. The representative lock driver 24 is shown in an open position. It is sometimes the case that a user of file cabinet 10 will open a drawer 18 and then move the lock driver 24 into a closed position, perhaps inadvertently. Such user may turn lock 20 with a key or in some instances may physically move the lock driver 24 upwards. The present subject matter provides for systems in which such lock driver 24 and thus the lock 20 may be kept in an open position when the drawer 18 of the file cabinet 10 is opened. In both the first present exemplary embodiment and the second present exemplary embodiment, those collective features of the primary actuator means (drive actuator) 36 which function in relation to such feature to prevent operation of lock 20 whenever a drawer is open may be alternatively referred to as the safety interlock means of the primary actuator means.

In accordance with the first present exemplary embodiment (that is, FIGS. 4 and 5), lock 20 includes a spring 28 that urges lock driver 24 into a notch 26. Although represented as a leaf spring, such spring 28 may be a coil spring or may be variously configured in accordance with other exemplary embodiments. Urging the lock driver 24 into the notch 26 prevents the lock driver 24 from being moved upwards within the slot 30. As such, positioning into the notch 26 causes the lock 20 to remain in an open position. Turning the key in lock 20 or manually pushing the lock driver 24 upwards will not cause the lock driver 24 to move upwards within the slot 30 due to its positioning within the notch 26.

In the second present exemplary embodiment (such as represented by FIG. 12 and others), the notch 26 and the spring 28 are replaced with a lock driver 24 that is provided as a two piece assembly. The forwardmost part is spring loaded outwardly. When drawer 18 is closed, such part is pushed backwards by the driver 40 in order to release the locking action of the arrangement.

Represented another way, referring back to FIG. 9*b* of the second present exemplary embodiment, the tip end of lock driver 24 is a plunger that moves inwardly (i.e., in the direction of arrow 25 of FIG. 9*b*) when drawer 18 is closed, to release the locking action of the arrangement. Otherwise, such tip end of lock driver 24 is a separate piece which is spring loaded in a direction opposite to that as represented by arrow 25 of FIG. 9*b*. As a result of such arrangement, pins on the actuator engage the above pin on the lock, which advantageously allows for or tolerates a significant amount of side to side misalignment.

Referring back to FIG. 3*b* and the first present exemplary embodiment, spline 32 is preferably provided as shown with a chamfer 34 on one end thereof. When a user closes drawer 18, lock driver 24 will be moved into contact with spline 32. In such manner, lock driver 24 will contact the chamfer 34 of the spline 32 and be urged in a horizontal direction out of the notch 26. Therefore, closing of the drawer 18 causes the lock driver 24 to engage the chamfer 34 of the spline 32 and hence to compress spring 28. Upon doing so, lock driver 24 is positioned out of the notch 26 and is at the bottom of the slot 30 in the open position. A user may then turn a key to move the lock 20 into a locked positioned thus causing the lock driver 24 to be moved upwards within the slot 30 into a locked positioned. As previously mentioned, lock driver 24 is in engagement with the spline 32 at such point in time to accordingly cause spline 32 to move upwards. Although more generally described as having such "lock out" feature, it is to be understood that the present systems may be configured in accordance with other exemplary embodiments so that lock 20 is not prevented from being moved into a locked position when the drawer 18 is opened.

Figure 6:
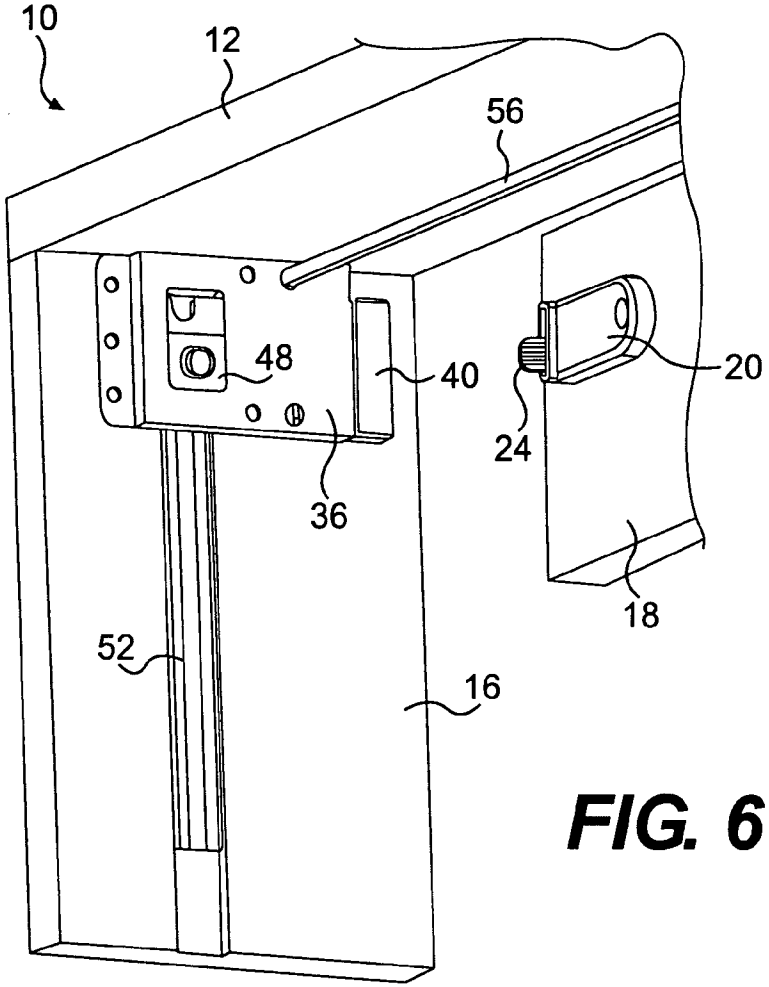
FIG. 6 is a perspective view of a portion of an exemplary file cabinet that employs an exemplary locking system in accordance with the first present exemplary embodiment.
Figure 13:
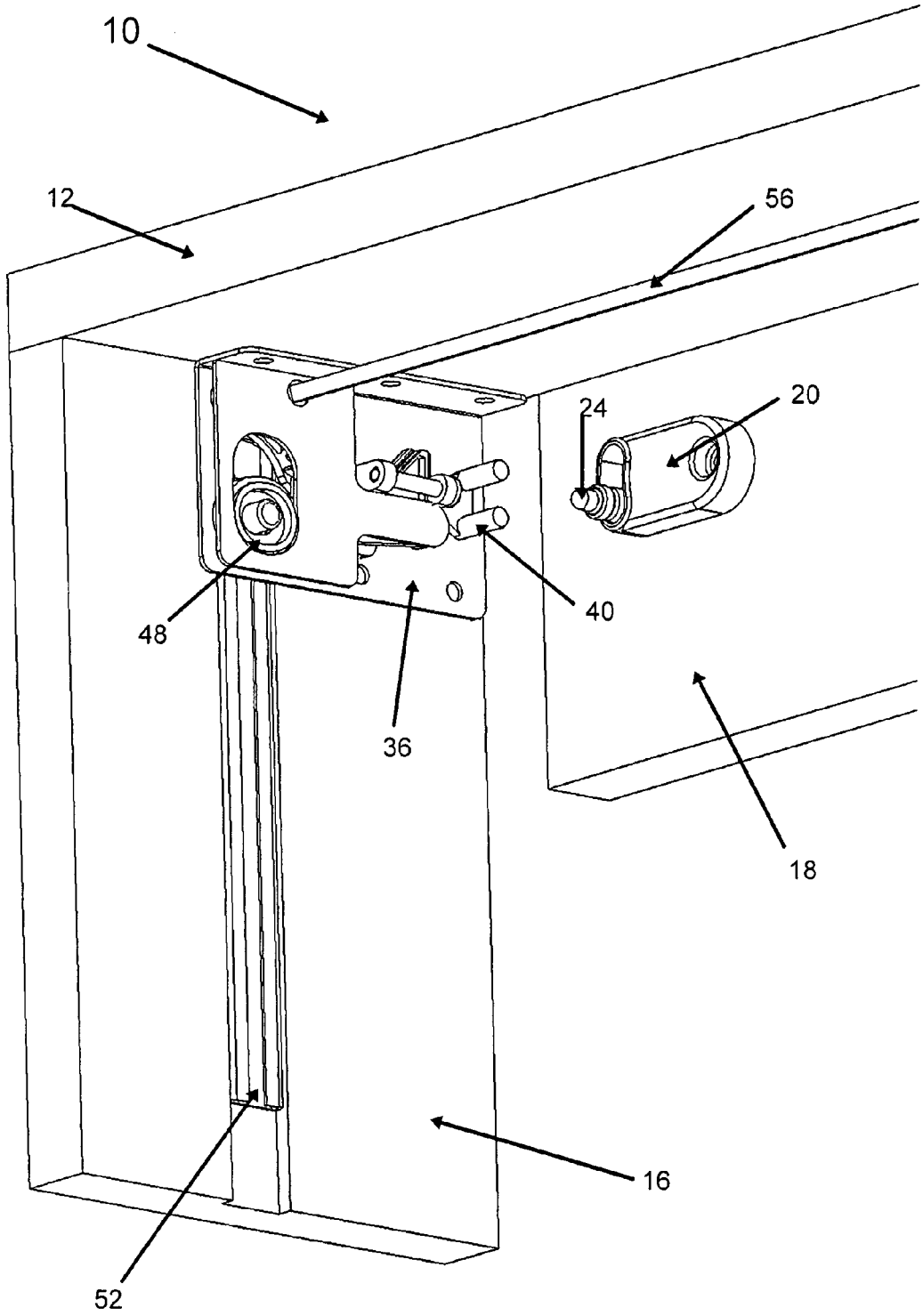
FIG. 13 is a perspective view of a portion of an exemplary file cabinet that employs an exemplary locking system in accordance with the second present exemplary embodiment.

FIGS. 6 and 13 respectively show for first and second present exemplary embodiments the relative positioning of the drive actuator 36, shaft 56, and lock 20 of the file cabinet 10. As previously discussed, closing of drawer 18 causes the lock driver 24 to engage the drive actuator 36. Locking and unlocking lock 20 thus causes drive actuator 36 to move lock bar 52 in a vertical direction on the side panel 16.

Figure 7:
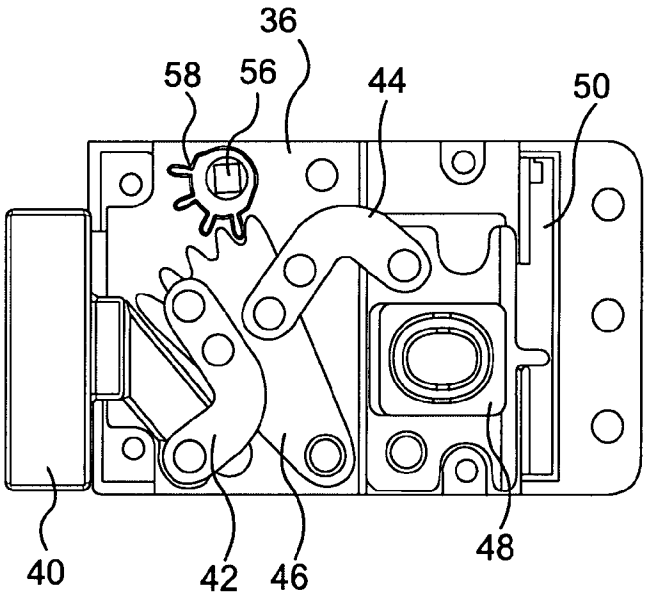
FIG. 7 is a back view of the exemplary drive actuator that shows various internal components thereof in accordance with the subject first present exemplary embodiment.
Figure 14:
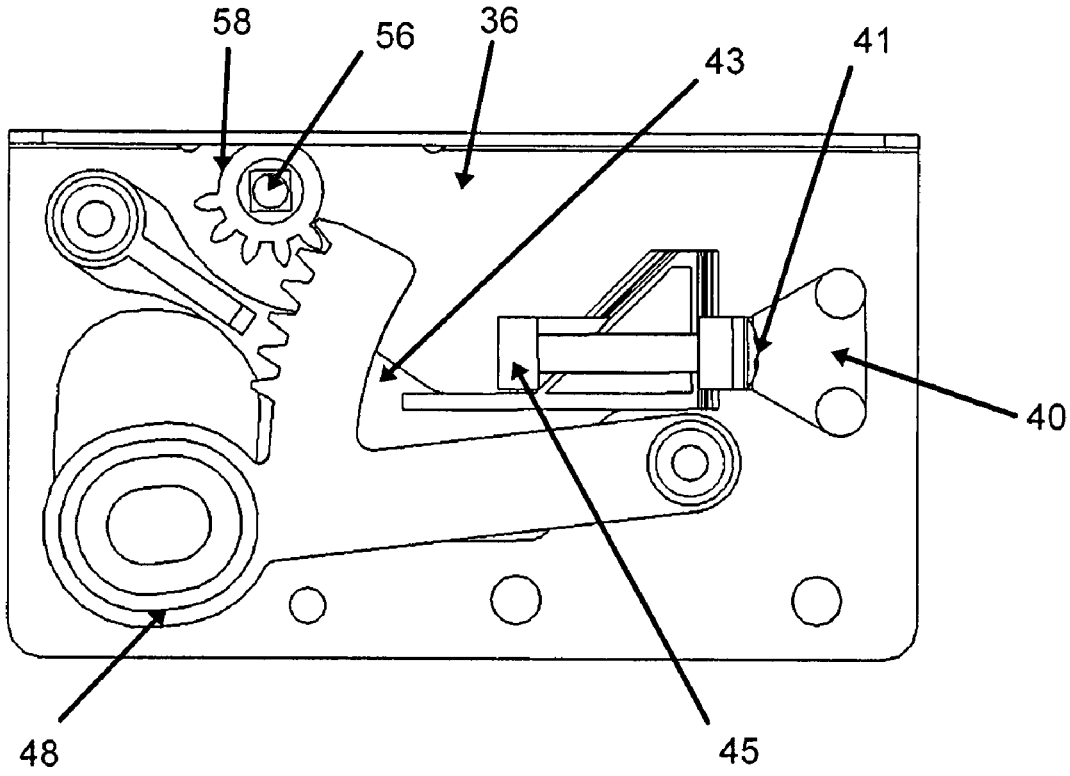
FIG. 14 is a back view of the exemplary drive actuator that shows various internal components thereof in accordance with the subject second present exemplary embodiment.

FIG. 7 shows drive actuator 36 in greater detail for the first present exemplary embodiment while FIG. 14 shows drive actuator 36 in greater detail for the second present exemplary embodiment.

In FIG. 7, spine 32 is incorporated into a driver 40. As such, movement of spline 32 causes a corresponding movement of driver 40. The drive actuator 36 is shown in an open position in FIG. 7.

Movement of driver 40 in an upwards direction in FIG. 7, as caused by upward movement of the lock driver 24 when engaging the spine 32, causes a first link 42 to be likewise moved in an upwards direction. The first link 42 is pivotably connected to the driver 40 and is also pivotably connected to a toggle arm 46. Upward movement of the first link 42 causes the toggle arm 46 to be moved in a clockwise direction. A second link 44 is provided and is also pivotably connected to the toggle arm 46 and pivotably connected to a lock bar slider 48. Clockwise movement of the toggle arm 46 causes an upward movement of the second link 44. The lock bar slider 48 is constrained so as to move only in a vertical direction. Upward movement of the second link 44 causes the lock bar slider 48 to move in an upward direction. The lock bar slider 48 is connected to the lock bar 52. As such, movement of the lock bar slider 48 in an upward direction causes the lock bar 52 to also be moved upwards with respect to the side panel 16. In the configuration shown in FIG. 7, movement of the lock bar slider 48 to an upper position corresponds to a locked position of the drive actuator 36. In this position, the lock bar 52 is moved into a position to prevent opening of the drawer 18 in a known manner.

Unlocking of the lock 20 causes the lock driver 24 to be moved downwards. Engagement with the spline 32 causes the spline 32 and the driver 40 to be moved downwards when the lock driver 24 is moved downwards. Downward movement of the driver 40 causes the first link 42 to be moved downwards and causes the toggle arm 46 to be pivoted in the counter clockwise direction. Likewise, the second link 44 is moved downward, thus causing the lock bar slider 48 to be moved downwards to move the lock bar 52 into an unlocked position.

Drive actuator 36 may be provided with a spring 50 in accordance with certain exemplary embodiments. The spring 50 acts against the lock bar slider 48 to help urge the lock bar slider 48 into an open position. The spring 50 may thus ensure that the lock bar slider 48 is moved into a completely open position when the driver 40 is moved downwards. It is to be understood, however, that the spring 50 need not be present in other exemplary embodiments.

The drive actuator 36 also includes a gear 58 that is in communication with the toggle arm 46. Clockwise movement of the toggle arm 46 causes a counter clockwise rotation of the gear 58, and counter clockwise movement of the toggle arm 46 causes a clockwise rotation of the gear 58. The gear 58 is connected to the shaft 56. On an opposite end, the shaft 56 is connected to a corresponding gear 58 of the slave actuator 38. Rotation of the shaft 56 causes the gear 58 in the slave actuator 38 to rotate and effect rotation of the toggle arm 46 in the slave actuator 38. As discussed with respect to the drive actuator 36, movement of the toggle arm 46 is translated into movement of the lock bar slider 48. As such, the lock bar slider 48 in the slave actuator 38 may be moved up and down in order to move the lock bar 54 of the side panel 14 into either a locked or an unlocked position.

The slave actuator 38 may be configured in a manner similar to the drive actuator 36 shown in FIG. 7. However, since driving of the slave actuator 38 is effected through the shaft 56, various components associated with the drive actuator 36 are not necessary in the slave actuator 38. For instance, the driver 40 and associated spline 32 need not be present. Additionally, the first link 42 need not be present in accordance with certain exemplary embodiments. The lock bar slider 48 of the slave actuator 38 may move in a vertical direction to move the lock bar 54 on the side panel 14 and thus effect a locking and unlocking of the various drawers 18 through a pin and drawer locking clip arrangement (not shown) as commonly known in the art.

FIG. 14 illustrates aspects of the present second exemplary embodiment, by which various different components are utilized vis-à-vis the subject matter of present FIG. 7 (concerning the first present exemplary embodiment). At the same time, elements, features, and/or components common to the respective embodiments represented by FIGS. 7 and 14 use shared reference characters in common, thus eliminating the need for repetitious discussion thereof.

In particular, and as will be well understood by one of ordinary skill in the art in view of the overall disclosure herewith, the FIG. 14 embodiment omits first and second links 42 and 44, toggle arm 46 and spring 50 as otherwise used in the FIG. 7 embodiment. Instead, the FIG. 14 embodiment is based, as shown, on use of an adjustment screw 41 which cooperates with an adjustment cam 45 and a lever arm 43 for effecting the same functions generally described above with reference to FIG. 7, as will be understood by those of ordinary skill in the art from the present disclosure without additional specific discussion. However, in such context it is to be understood with reference to FIG. 14 that there is a pin on the bottom surface of the lock bar slider 48 (though not in view per FIG. 14), that engages a slot (also not viewable per FIG. 14) on the lever arm 43. Such engagement causes the lock bar slider 48 to rotate clockwise and raise the lock bar 52 whenever lever arm 43 is rotated counter-clockwise. Such lever arm 43 is rotated counter-clockwise by the engagement of the lock 20 into the driver 40.

In accordance with one present exemplary embodiment, turning a key 180° in the keyhole 22 causes lock bars 52 and 54 to be raised ½". Movement of such respective lock bars 52 and 54 causes the drawer 18 to be locked proximate to both the left hand side panel 14 and the right hand side panel 16. Thus, even by locking drawer 18 on either end thereof, a relatively greater degree of security will be realized due to practice of the presently disclosed subject matter. For example, locking on either end may limit such exemplary drawer 18 to be opened a maximum of ⅛" at any point along its length.

The drive actuator 36 is configured so that partial movement of the driver 40 causes a rapid initial movement of the lock bar slider 48. In accordance with certain exemplary embodiments, movement of the driver 40 over 60% of its travel may correspond to a 90% movement in the travel length of the lock bar slider 48. As such, the drive actuator 36 may be configured so that the movement ratio between the driver 40 and the lock bar slider 48 is non-proportional. It may be advantageous to employ a non-proportional drive actuator 36 in accordance with certain exemplary embodiments to allow for losses in the system while still enabling the lock bar slider 48 to travel a desired length to lock the file cabinet 10.

In accordance with one exemplary embodiment, movement of the lock bar slider 48 of approximately ½" may be used in order to move the lock bar 52 into and out of a locked position. In order to obtain approximately ½" of travel of the lock bar slider 48, the drive actuator 36 may be configured so that the driver 40 moves approximately ⅜" in travel to result in approximately ½" travel of the lock bar slider 48.

Toggle arm 46 of FIG. 7 (or lever arm 43 of FIG. 14) may be provided to ensure that the majority of the lock bar slider 48 (in both present exemplary embodiments) motion occurs during the first part of the driver 40 movement. Movement of the toggle arm 46 (or lever arm 43 of FIG. 14) from an unlocked positioned to a locked position of the drive actuator 36 may cause the gear 58 to rotate 90°. As previously discussed, such rotation will be transferred to the follower or slave (secondary) actuator 38 in order to drive such secondary actuator 38, and thus move the lock bar 54.

Losses in the system may cause the lock bar 54 associated with the secondary or follower actuator 38 to move less of a distance than the lock bar 52 associated with the drive actuator 36. For example, movement of ½" of the lock bar 52 due to the drive actuator 36 may correspond to only a movement of ⅜" of the slave actuator 38. The system may be configured in order to compensate for any losses associated therewith. For example, lock bar 54 may be designed so that a movement of only ⅜" is still within a necessary tolerance range in order to effect locking and unlocking of drawer 18. Alternatively, the drawer locking clips and pins associated with the lock bar 54 may be configured to effect locking of the drawers 18 through only ⅜" of travel of the lock bar 54. Additionally or alternatively, the follower or slave actuator 38 may be geared or otherwise adjusted in order to compensate for any losses so that the lock bar slider 48 and lock bar 54 move a desired distance.

It should be understood that any ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein included all other limits included in the mentioned limits. For instance, a limit of up to 7 also includes a limit of up to 5, up to 3, and up to 4.5.

While the present subject matter has been described in detail with respect to specific embodiments thereof, it will be appreciated that those skilled in the art, upon attaining an understanding of the foregoing may readily produce alterations to, variations of, and equivalents to such embodiments. Each example is provided by way of explanation of the present subject matter, and not meant as a limitation of the present subject matter. For example, features illustrated or described as part of one embodiment can be used with another embodiment to yield still a third embodiment. It is intended that the present subject matter include these and other modifications and variations.

Accordingly, the scope of the present disclosure is by way of example rather than by way of limitation, and the subject disclosure does not preclude inclusion of such modifications, variations and/or additions to the present subject matter as would be readily apparent to one of ordinary skill in the art. Specifically, it is intended for the present subject matter to include all alternatives, modifications, and equivalents as may be included within the spirit and scope of the following claims.

What is claimed is:

1. A locking system for a file cabinet having at least one drawer which is movable between an open and closed position thereof relative to the file cabinet, and which file cabinet has respective left and right side panels, said locking system comprising:

respective left and right lock bars that slide generally vertically for alternately locking and unlocking depending on their vertical positioning;

a lock having a keyhole for receipt of a key therein for placing said lock in one of either a predetermined locked position or a predetermined unlocked position thereof;

a drive actuator, engaged with said lock and associated with one of the respective left and right lock bars, such that movement of said lock between said locked and unlocked positions thereof is translated by said drive actuator into vertical slide motion of the associated one lock bar for corresponding locking and unlocking;

a connection member, operatively associated with said drive actuator for corresponding movement thereof as the associated one lock bar is moved by said drive actuator; and a follower actuator, engaged with said drive actuator via said connection actuator and associated with the other of the respective left and right lock bars, such that movement of said lock between said locked and unlocked positions thereof which is translated by said drive member to the associated one lock bar is also translated by said follower actuator into vertical slide motion of the associated other lock bar for corresponding locking and unlocking, such that locking and unlocking functionality of said lock is positively translated between the respective left and right lock bars;

wherein said lock further includes a lock driver comprising a resiliently mounted plunger pin, which is biased by such resilient mounting thereof for a position which prevents said lock from assuming a locked position while the locking system is in an open position; and wherein said drive actuator defines at least one pin situated for deflecting said plunger pin of said lock driver whenever the locking system is in a closed position, so as to permit the lock to assume a locked position thereof, whereby said lock driver is prevented from being moved into a locked position whenever the locking system is in the open position.

2. A locking system as in claim 1, wherein said connection member comprises a rotatable shaft, rotatably mounted and associated with said drive actuator and said follower actuator such that rotation of said rotatable shaft by said drive actuator causes rotatable movement to be transmitted to said follower actuator.

3. A locking system as in claim 1, wherein said vertical slide movement effected by said drive actuator is not one-to-one proportional to the actuating movement received by said drive actuator.

4. A locking system for a file cabinet having a plurality of drawers which are movable between respective open and closed positions thereof relative to the file cabinet, and which file cabinet has respective left and right side panels, said locking system comprising:

a lock having a keyhole for receipt of a key therein for placing said lock in one of either a predetermined locked position or a predetermined unlocked position thereof in response to corresponding rotational movement of a key in such keyhole;

elongated respective left and right lock bars that slide generally vertically within for alternately locking and unlocking depending on their vertical positioning;

a connecting shaft member, rotatably supported, said connecting shaft member having respective ends thereof situated respectively adjacent a primary actuator and a secondary actuator;

said primary actuator, operatively engaged with said lock, with one of said respective left and right lock bars, and with one respective end of said connecting shaft member, such that movement of said lock between said locked and unlocked positions thereof is translated by said primary actuator into vertical slide motion of said associated one lock bar for corresponding locking and unlocking, and is translated into rotational movement of said connecting shaft member; and said secondary actuator, engaged with the other respective end of said connecting shaft member and associated with the other of said respective left and right lock bars, such that movement of said lock between said locked and unlocked positions thereof which is translated by said primary member to said one respective end of said connecting shaft member is also translated by said secondary actuator into vertical slide motion of said associated other lock bar for corresponding locking and unlocking, such that locking and unlocking functionality of said lock is positively translated to both of said left and right lock bars;

wherein said lock further includes a lock driver comprising a resiliently mounted plunger pin, which is biased by such resilient mounting thereof for a position which prevents said lock from assuming a locked position while the locking system is in an open position; and wherein said primary actuator defines at least one pin situated for deflecting said plunger in of said lock driver whenever the locking system is in a closed position, so as to permit the lock to assume a locked position thereof, whereby said lock driver is prevented from being moved into a locked position whenever the locking system is in the open position.

5. A locking system as in claim 4, wherein said vertical slide movement effected by said primary actuator is not one-to-one proportional to the actuating movement received by said primary actuator.

6. An improved file cabinet locking system for a file cabinet having a plurality of drawers which are movable between respective open and closed positions thereof relative to the file cabinet, and which file cabinet has respective left and right side panels, said locking system comprising:

a lock having a keyhole for receipt of a key therein for placing said lock in one of either a predetermined locked position or a predetermined unlocked position thereof in response to corresponding rotational movement of a key in such keyhole;

respective left and right look bar means, for alternately locking and unlocking such drawers;

rotatable shaft means, for translating rotatable movement disposed between a said primary actuator means and a secondary actuator means;

primary actuator means, operatively engaged with said lock, with one of said respective left and right lock bar means, and with said rotatable shaft means, for actuating said associated one lock bar means in response to movement of said lock between said locked and unlocked positions thereof, for corresponding locking and unlocking of the drawers, and for correspondingly rotating said rotatable shaft means; and said secondary actuator means, operatively engaged with said rotatable shaft means and with the other of said respective left and right lock bar means, for actuating said associated other lock bar means in response to rotation of said rotatable shaft means by said primary actuator means, such that locking and unlocking functionality of said lock is positively translated between said left and right lock bar means;

wherein said primary actuator means further includes safety interlock means operatively associated with said lock, for preventing said lock from assuming said locked position thereof whenever the locking system is in an open position.

7. An improved file cabinet locking system as in claim 6, wherein said respective left and right lock bar means comprise elongated respective left and right lock bars that slide generally vertically for alternately locking and unlocking depending on their vertical positioning.

8. An improved file cabinet locking system as in claim 6, wherein said actuating of said associated one lock bar means by said primary actuator means is not one-to-one proportional to movement of said lock between said locked and unlocked positions thereof.

9. An improved file cabinet locking system as in claim 6, wherein said primary actuator means further includes adjustment screw means for adjusting operation of said primary actuator means.

* * * * *

UNITED STATES PATENT AND TRADEMARK OFFICE

CERTIFICATE OF CORRECTION

PATENT NO. : 7,665,812 B2
APPLICATION NO. : 11/493868
DATED : February 23, 2010
INVENTOR(S) : Gregg W. Walla It is certified that error appears in the above-identified patent and that said Letters Patent is hereby corrected as shown below:

In Column 14, line 58, please delete the word "within";

and in Column 15, line 24, please replace the word "in" with "pin"

Signed and Sealed this

Fourth Day of May, 2010

David J. Kappos

David J. Kappos
*Director of the United States Patent and Trademark Office*